United States Patent [19]

Rinehart

[11] Patent Number: 4,792,812

[45] Date of Patent: Dec. 20, 1988

[54] MICROWAVE EARTH STATION WITH EMBEDDED RECEIVER/TRANSMITTER AND REFLECTOR

[76] Inventor: Wayne R. Rinehart, P.O. Box 53, Concord, Calif. 94520

[21] Appl. No.: 782,028

[22] Filed: Sep. 30, 1985

[51] Int. Cl.[4] ..... H01Q 19/14

[52] U.S. Cl. ..... 343/781 R; 343/784; 343/840; 343/873

[58] Field of Search ..... 343/912, 872, 873, 840, 343/786, 916

[56] References Cited

U.S. PATENT DOCUMENTS 2,668,869 2/1954 Iams ..... 343/912

3,015,102 12/1961 Crane et al. ..... 343/912

*Primary Examiner*—Eugene R. LaRoche

*Assistant Examiner*—Seung Ham

*Attorney, Agent, or Firm*—Armand G. Guibert

[57] ABSTRACT

A low-cost, essentially self-contained microwave earth station having a reflector dish together with the microwave sensing/emitting elements embedded in a rigid, low density and low thermal conductivity plastic foam. At least the sides and back of the unit may be encased in a fiberglass-resin shell. Shielding for terrestrial interference also may be present. For a receive-only station, a low noise amplifier together with frequency conversion and channel selection (or all-channel transmission) to circuits may also be embedded in the foam. The only connections to such a receive-only unit are a line from a d-c source of power for supplying the required operating voltages to the electronics, and a coaxial cable supplying the selected one of the received information signals to the TV display or other device utilizing those signals. Preferably, a single coaxial line with the dual function of information output and d-c power input is employed.

32 Claims, 3 Drawing Sheets

MICROWAVE EARTH STATION WITH EMBEDDED RECEIVER/TRANSMITTER AND REFLECTOR

BACKGROUND OF THE INVENTION

1. Field of the Invention

The invention relates to microwave receiver/transmitter earth stations of the type having a reflector dish and, in particular, to low cost structures for such.

2. Prior Art

Microwave receiver/transmitters of the so-called reflector dish type have long been known in the communications industry. To date, most have been of industrial quality, namely—large, exceptionally ruggedly constructed units suitable for long-lived use in remote locations. Examples of such units are the relay stations installed by telephone companies. Units of this type cost one or more thousands of dollars. With the advent of communications satellites sited in geosynchronous or "parking" orbits some 22,300 miles above the earth's equator (in the so-called "Clarke Belt"), broadcasting of television and other signals from end to end of a continent or even from one continent to another with just one relay station (the satellite) has been made possible, but a high cost of the receivers—if it persists—would be a barrier to establishment of a market among the members of the general population. Further, the prior dishes have generally been heavy, ungainly and unsightly—particulary when formed of open framework—and (where non-uniformly exposed to the full strength of the sun's rays) have a tendency to warp, with resultant decrease in stability of the response characteristic to the input signals. This last has usually been taken care of by introduction of compensating electronic circuits with corresponding increase in actual cost of the item.

Use of plastic foams has long been known in conjunction with antennas in general and also with respect to those of the reflector dish type—e.g., patents such as U.S. Pat. Nos. 2,689,304; 3,169,311; 3,374,482; 3,381,371 and 3,745,158. The teachings in these patents relate to methods of making lightweight reflectors, embedment of a tilted reflector as a means of reducing dynamic unbalance of rotating radar scanners, combination of this last with a gyro rotor, and lastly, embedment of a double halo marine frequency antenna after separating the halos a predetermined distance by use of a number of spacers. Clearly, these patents do not address and solve the problems of supporting microwave receptor elements without deleterious effects of tripodal support arms on signal power and similarly undesirable effects of warping attendant upon non-uniform solar heating of the reflector dish. Moreover, none of these patents show embedment of electronic circuits along with the antenna elements because, as known, high heat dissipation of a-c/d-c power converters when combined with low thermal conductivity of plastic foam adversely affects active elements of these circuits, resulting in high probability of an early failure (thermal runaway).

Thus, there is need for a low cost, relatively light weight, compact, and yet thermally stable microwave earth station suitable for use in the mass market.

SUMMARY OF THE INVENTION

The invention resides generally in an improved microwave receiving/transmitting earth station of the type having a reflector dish in a shape concentrating intercepted rays of a microwave signal beam at a focal point on the axis of the dish, a feed horn being located thereat to interact with the focussed beam, and the dish being alternatively adapted to emit a beam of microwave signals generated by a microwave source, the signals being supplied to the feed horn for beam emission; together with a signalconducting member connecting the feed horn to a utilization device/the source of microwaves. In particular, the improved earth station comprises (a) a layer of thin, microwave reflective material forming the reflector dish, the dish having a front and a back; (b) a first mass of material transparent to the microwave beam and having a discrete surface portion in a shape matching the front of the dish, the first mass projecting beyond the focal point by an amount sufficient to encompass the feed horn and thereby provide the sole support therefor as well as the spacing thereof from the dish; (c) a second mass of the transparent material, the second mass having a particular surface portion in a shape matching the back of the dish; and (d) means integrating the layer of thin, microwave reflective material the first mass of transparent material, and the second mass of transparent material into a composite unit having the layer reinforcedly supported between the first and second masses.

As a feature of the invention, thermal instability due to solar irradiation is avoided by use of low thermal conductivity, low density, rigid plastic foam for fabricating the composite unit.

Another feature of the invention, is that for the receiveonly version, at least a low-noise amplifier and optionally a downconverter and satellite receiver channels may also be supported in the composite unit, the problem of readily dissipating internally generated heat from any of these embedded elements being resolved by retaining only d-c powered portions of elements in the composite unit.

As yet another feature of the invention, application of the technique to larger units is made possible by a modularization of the composite unit.

Other features of the invention as well as advantages of same will be found in the following detailed description of the preferred embodiments with reference to the accompanying drawing.

DESCRIPTION OF THE PREFERRED EMBODIMENTS

Figure 1:
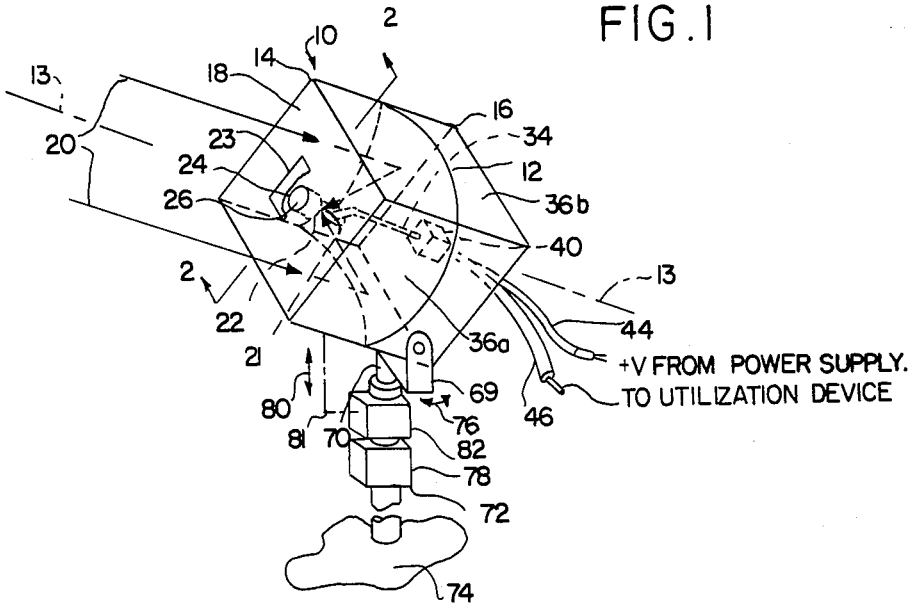
FIG. 1 is a perspective view of a microwave earth station according to a first embodiment of the invention.

A first embodiment of an earth station 10 according to the invention is shown in FIG. 1, where a first layer 14 made of a material readily penetrable by microwave radiation, a second, thin parabolic reflector layer 12; and a third layer 16 of the same (or similar) microwave-penetrable material form a composite unit in the shape of a cube 10 (or other parallelepiped) about four feet on each side, say, or larger if needed. Layer 14 and layer 16 preferably are made of rigid, low density plastic, formed—for example—by molding polystyrene beads using longknown techniques. Alternatively, they could be foamed-in-place in a likewise known fashion—e.g., by use of a two-part epoxy foam system such as that available from Tap Plastics Inc. of Dublin, Calif. They could also be carved from blocks of styrofoam, as is also known.

Figure 2:
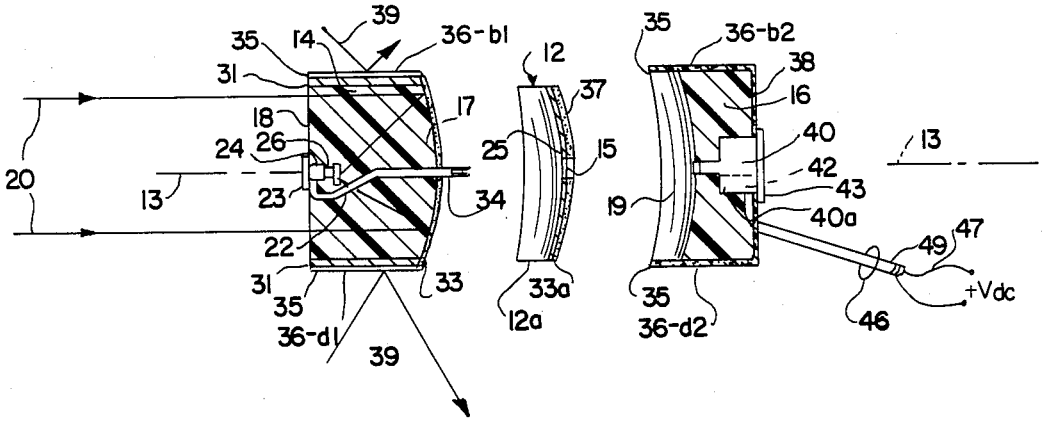
FIG. 2 shows an exploded cross-sectional view of the microwave earth station of FIG. 1.

As best seen in the exploded cross-sectional view of FIG. 2, layer 14 is preferably molded such that it has a planar front surface 18 and planar sides 36-b1, 36-d1 (respectively, the upper and lower sides when facing the front surface 18 in FIG. 1), together with a convex parabolic back surface 17 having a focal point 21 on a central axis 13 of reflector 12. Similarly, layer 16 is molded such that it has a concave parabolic front surface 19 matching the back surface 17 of layer 14, of course, together with a planar back surface 38 and planar sides 36-b2, 36-d2 (again, respectively, the upper and lower sides when facing the front surface 18 in FIG. 1). To form cube 10, the parabolic back surface 17 of layer 14 is first coated in known fashion (brushing, say) with a layer 33 of adhesive (e.g. "Elmer's Latex Wood Glue" manufactured by Borden Inc. of Columbus, Ohio) then preferably covered with a layer **12*a*** of thin metal foil (such as 0.010" thick aluminum).

Front surface 25 of foil layer **12*a* is next conformed manually, say, to the contours of back surface 17 to form the microwave reflector layer 12 or "reflector" 12 (as earth station 10 will be termed hereinafter for convenience). Thereafter, a further coating 33*a* of the same adhesive is applied to convex back surface 37 of foil 12*a* and layer 16 is then joined to layer 14 with reflector 12 intervening between the two so as to form the basic cube 10. Although reflector dish 12 has been described above as being formed of a thin aluminum foil layer 12*a***, it will be evident that it could equally well be formed of known aluminum fibers or known reflective paints of the type containing fine metallic particles. As used hereinafter, the term "foil" will include such equivalents.

To prevent impingement of stray microwave radiation 39 on reflector 12—often referred to in the art as terrestrial interference or "TI"—the four sides of layer 14 only sides 36-b1 and 36-d1 being shown in FIG. 2) are preferably covered with a shield or skirt layer 31 of thin aluminum foil similar to **12*a*. Lastly, for protection of cube 10 from vandals or weather (if not concealed in the usual shelter—a simulated tool-shed, cabana or the like), an external fiberglass-resin layer 35 may be applied by known techniques. Layer 16 could be omitted, if desired, and layer 35 applied directly to back surface 37 of foil 12*a***.

While cube 10 may be realized using the structure disclosed above and incorporating known transmitting-/receiving elements (such as equipment utilized in the microwave antennas available from Andrew Corporation of Orland Park, Illinois), for brevity, just the receive-only version of the earth station according to the invention will be described in detail. Cube 10 is normally oriented such that axis 13 of reflector 12 is parallel to the rays of microwave beam 20 and thus these last are focused by reflector 12 onto a point 21 at an inner end 22 of a cavity 24 in layer 14. Outer end **18*a* (FIG. 3) of cavity 24 is defined by the planar front surface 18 of layer 14, sufficient depth and width being provided to permit cavity 24 to accept within it a microwavesensing assemblage 26 responsive to beam 20 (which has a frequency in the range of several gigaherz—e.g., 3.8 to 4.2 gHz and may be even higher, if necessary). Assemblage 26 serves to extract, in known fashion, desired video or other information signals from beam 20 with output at a lower frequency compatible with common TV equipment. Assemblage 26 may be temporarily supported on axis 13 in known fashion (clamped to the mold, say) in operative position relative to dish 12 and then foamed in place to hold it in that position. On the other hand, cavity 24 may first be formed by use of an appropriately-shaped, removable insert, as is also known, to provide a friction fit for assemblage 26 and this last then forced down into cavity 24 until it contacts inner end 22. Alternatively, the cavity 24 may be dimensioned to provide a sliding fit for assemblage 26 and this last slipped into cavity 24, brought into contact with end 22 (just as above), where it may next be cemented, again using adhesive 33, say. In all cases, outer end 18*a* is covered with an access panel 23 preferably provided with vents 23*a*** for reasons discussed subsequently.

Microwave-sensing assemblage 26 may comprise a known feed horn 28 and a low-noise amplifier **28*a* (respectively, Uniden's Unirotor Model UST 460 made by Satellite Technology, Inc. of Indianapolis, Ind. and Drake Model 2576 LNA (75°–85°) made by R.L. Drake Company of Miamisburg, Ohio) together with an equally well-known frequency downconverter 30 (preferably compatible with choice of the TV channel device or transponder, described subsequently). Amplifier 28*a* and downconverter 30 are serially connected to this last by a short length of standard RG 213 ultrahigh frequency, flexible coaxial cable 32. A rigid, N-type connector may be used in place of cable 32 if a close-coupled, in-line arrangement is desired. (All these items are available, ordinarily, from a microwave equipment supply house such as Echosphere West Company of Sacramento, Calif.) Downconverter 30 and connecting cable 32** may be relocated, if desired, in some applications. Also, though FIG. 3 shows the elements 28*a* and 30 as being axially aligned with feed horn 28, they may be located behind it in a more compact arrangement (not shown, but known), though at possible cost of slight loss in signal power, if there is increased blockage of beam 20.

Figure 4:
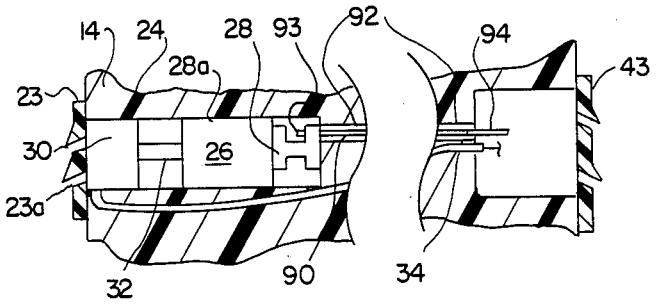
FIG. 4 shows a modification of the enlarged view of FIG. 3 in which a microwave-transparent rod attached to the microwave-sensing element traverses the earth station near the axis of the reflector from the focal point to a back cavity and is available for a slight manual re-positioning of the sensing-element, if necessary, to develop the optimum signal output.

It may be remarked at this point that, for best results, provision should be made for minor adjustment in the rotational and axial position of feed horn 28 to achieve a final setting. The need for these adjustments stems from tolerance accumulations in manufacturing cube 10 and in the 180° polarization of satellite signals having the same frequency, the satellite then having a doubled channel capacity. The adjustments may be made by visual inspection of the picture received, or by use of a known signal strength meter. Rotational and axial adjustment may be somewhat difficult to perform through panel 23 after cube 10 has been mounted on post 72 of FIG. 1 and directed to align it with beam 20 from a particular satellite. FIG. 4 accordingly shows a further improvement in which a microwave-transparent (e.g. nylon) rod 90 is connected eccentrically and rigidly (as by a screw-threaded, shouldered end 93 and matching nut, say) to horn 28. Rod 90 extends rearwardly via a passageway 92 into the cavity 40*a*, where about an inch or two of rod 90 protrudes to form a grip portion 94. Passageway 92 is made sufficiently large to allow slight arcuate movement (+/−10°) of rod 90 by lateral displacement of portion 94, causing horn 28 to rotate likewise and attain a rotational position yielding a first improvement in the signal. Then, by pulling or pushing axially on rod 90, horn 28 can be moved inward or outward by the small fraction of an inch possibly needed to develop the true peak signal. The order of the "peaking" adjustments just given could be inverted and the same result obtained, of course.

Figure 3:
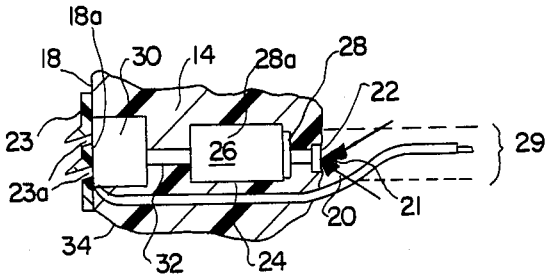
FIG. 3 shows an enlarged view of the elements for sensing a microwave beam impinging on the reflector in the microwave earth station of FIG. 1 and for converting the beam into a signal of lower frequency, these elements being supported on the reflector axis at the focal point of the reflector without benefit of the usual "buttonhooks" or tripodal support arms or other form of separate spacers.

It will be noted (see the exploded view of FIG. 2 and an enlarged view in FIG. 3 showing cavity 24 and its contents in block form) that by locating assemblage 26 in cavity 24, all support for assemblage 26 is derived from layer 14 without requiring any of the previously-used support arms (so-called "buttonhooks" or tripods) with their known interference with and resultant reduction of the strength of beam 20. Furthermore, optimum spacing from reflector 12 is set by the above-described "peaking" adjustments and layer 14 then retains that spacing by engagement with feed horn 28 (frictionally or by introduction of adhesive or additional foam).

Output from microwave assemblage 26—an information modulated carrier wave operating at 70 mHz, say—preferably is to a flexible coaxial cable 34 of standard type—e.g., a 75-ohm shielded unit. Cable 34 is preferably run rearwardly in the shadow 29 of feed horn 28 and then through a suitable aperture 15 in reflector 12 toward back surface 38 of cube 10 (cable 34 may also be run along a longer route over or just below front surface 18 and one of the lateral surfaces 36*a*, 36*b* to the back surface 38, although as between increased shadow of the former and increased conductor length of the latter, the trade-off seemingly favors the former). Cable 34 is connected to a full set of known TV channels (called "transponders" in the art), shown generally as a box 40 near back surface 38 in FIG. 1. These channels or transponders are referred to as "TVRO" in the communications industry when microwave transmission capabilities are not included, earth station 10 then being intended to operate in a receiving mode only, as in this exemplary description. Representative units are, say, the Model 7600A receiver and associated downconverter in the Model 5800 Test Equipment of Gillespie & Associates, now Geo Tech Communications Co. at Milpitas, California. Because of ready interfacing with the satellite tracking device identified subsequently, the Drake Model ESR 240A receiver made by R. L. Drake Co. (previously-mentioned) is believed more preferable. Choice of a transponder must be accompanied, for best results, by use of a known matching downconverter—normally that supplied with the particular make and model of transponder, though equivalents may be used where desirable.

Box 40 (together with its contents) is preferably foamed in place while forming layer 16, or may be lodged in a matching cavity 40*a* formed—as mentioned above—by use of an appropriatelyshaped insert during that same procedure. Location of box 40 is not critical at all, except for considerations of minimizing the length of cable 34. In a multiple-user version (e.g. trailer parks), box (channels) 40 may include for each channel a known low-power transmitter unit of very short range (i.e., range being limited by use of individual, known stub antennas, not shown in FIG. 1). For single user (home) applications, box 40 may alternatively include known high frequency or infra-red responsive channel selection circuits 42. Cavity 40*a* is again preferably covered with a vented access panel 43 which may be similar to panel 23 except that it need not be transparent to microwave radiation. The reason for venting cavities 24 and 40*a* will next be discussed.

In view of the very low thermal conductivity of most plastic foams (polystyrene, polyurethane, etc.), layers 14,16 reduce the inward flow of heat resulting from exposure of cube 10 to solar irradiation, but note that they likewise reduce the outward flow of heat corresponding to energy dissipated within the circuits of assemblage 26 and box 40, (comprising the lownoise amplifier 28, downconverter 30, and channel selection circuits 42). Hence it is desirable first to limit such dissipation and second to augment cooling of the electronic circuits. Accordingly, cavities 24 and 40*a* are convectively cooled by use of vented cover panels 23, 43. Moreover, all power supply components (the primary source of much heat) are preferably remotely located with respect to cube 10. Only d-c power is supplied to cube 10. This may be done (see FIG. 1) via a two-wire lead 44 from cube 10 to the remote source of d-c power +V. As shown in that figure, lead 44 is separate from a further coaxial cable 46—which may be identical in type to cable 34—ordinarily only supplying display information to the TV (or other utilization device). More preferably, this is done by dual use of cable 46. By biasing central lead 47 of cable 46 to +V relative to a ground shield 49 (as depicted in FIG. 2), d-c power may readily be supplied to electronic circuits 28,30 and 42. Cable 46 is then advantageously the sole lead from cube 10.

Before discussing some further embodiments, it should be mentioned that cube 10 is normally intended for fixed installation, being attachable to a biaxial mounting (e.g., on "gimbals") as shown in semi-schematic form in FIG. 1, where cube 10 is pivotally supported on a bracket 69 rigidly fastened to a shaft 70 rotatable within a cylindrical post 72 anchored in the usual concrete pad 74. Shaft 70 may be rotated bidirectionally (indicated by a double-headed arc 76) under control of a known d-c powered worm-gear drive 78. Similarly, pivoting of cube 10 about bracket 69 to change the angle of inclination (double-headed arrow 80) is depicted by the dash-dot line 81 between cube 10 and another d-c powered worm-gear drive 82. Dash-dot line 81 represents any one of many well-known gear-driven linear actuators. Drives 78,82 may be remotely-controlled to "home-in" on a desired satellite by the user's operation of a well-known high-frequency wireless channel selector. The discrete signal emitted by the selector may, for instance, cause a program in the circuits of a tracking device (not shown, but known - e.g., a Houston "Tracker IV" made by Houston Satellite Systems of Houston, Texas) to control azimuth positioning by drive 78, and a similar tracking device programmed to control elevation of cube 10 by drive 82.

Figure 5:
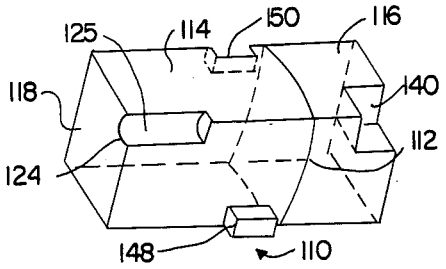
FIG. 5 shows a modular construction for a microwave earth station according to a second embodiment of the invention.

As is known, signals from satellites vary in strength at the earth's surface beneath them, the "footprints" (so-called because of their shape) being so much weaker in fringe areas that a four-fold increase in size of reflector 12 is necessary in order to achieve the same image quality as in the central, strongest signal area (e.g., Denver, Colo. for continental U.S.) with the same power to microwave assemblage 26. A modular construction according to a second embodiment of the invention is therefore shown in FIG. 5. There, cube 10 of FIG. 1 has been subdivided into four identical parts or "modules" 110 (only one being shown) readily transportable to a desired site for easy assembly into a complete receiver/-transmitter having the sensing elements of assemblage 26 (not shown in FIG. 5) lodged in a cavity equivalent to cavity 24, but formed by four quarter-cylinders 124 in the example chosen for purposes of this description. Alignment to bring the four sections 112 of parabolic reflector 12 together properly is provided, say, by the interaction of a key 148 on each given module 110 and a corresponding notch 150 in the module 110 counter-clockwise from it. Modules 110 are preferably cemented together (using a suitable adhesive such as that previously-mentioned) during assembly into a complete cube 10. Though each quarter cavity 124 of FIG. 5 is shown with a smooth surface 125, its shape could be made complementary to that of assemblage 26. If the surface of that assemblage possesses assymetric features, then modules 110 may need differential characteristics to prevent improper assembly—for example, keys 148 and notches 150 may be formed in mutually exclusive sets. While the arrangement of FIG. 4 has been described in terms of subdivision into just four parts, it will be recognized that a greater number of parts is possible, though maintaining accuracy of reintegration of reflector 12 when assembling modules 110 becomes more difficult as that number increases.

Figure 6:
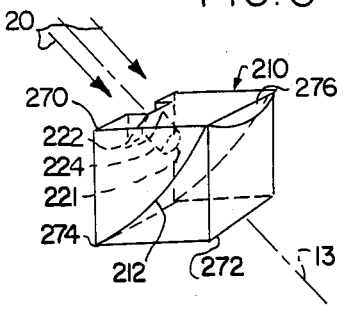
FIG. 6 is a perspective view of a microwave earth station according to a modification of the embodiment of FIG. 1 wherein the axis of the reflector dish passes through the middle of opposing edges of the cube.
Figure 7:
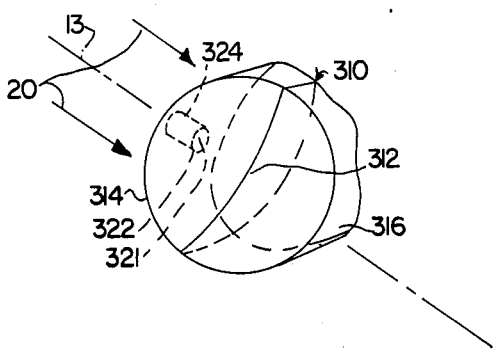
FIG. 7 is a perspective view of a microwave earth station according to a third embodiment in which the reflector dish is spanned along the diameter of a right-circular cylinder.

While the first embodiment shows microwave earth station 10 as being cubical in shape and having the reflector axis 13 passing through the center of opposed faces 18 and 38, it will be appreciated that many other shapes and orientations may have discrete advantages and thus be desirably adoptable in practicing the invention. As one example (see FIG. 6), axis 13 of a parabolic reflector 212 may be oriented so as to pass through the middle of each of the edges 270, 272 of a parallelepiped 210 having a square cross-section as in FIG. 1, but reflector 212 here being spanned substantially along a diagonal between edges 274,276 thus yielding a considerable gain in surface area for reflector 212. As currently envisioned, the arrangement of FIG. 6 is more preferred, requiring little adjustment in the angle of inclination of parallelepiped 210 for optimum interception, while maintaining a lower profile. An example of a different shape is shown in FIG. 7, where a parabolic reflector 321 is spanned substantially along a diameter of a cylindrical section 310 suitably dimensioned in accordance with the interception area needed. As before, a cavity 324 in a forward portion 314 of section 310 is aligned with axis 13 of reflector 312, the inner end 322 of cavity 324 being located in the plane of focal point 321 of reflector 312. Though not shown, a cavity similar to 40 in FIG. 1 could also be provided in portion 316, if desired. Should the size of section 310 be such that focal point 321 falls outside forward portion 314, an additional projection (not shown in FIG. 7) in the form of a truncated pyramid or a parallepiped, could be included to provide the requisite volume for supporting assemblage 26.

Because of the compactness and self-contained nature of the cube 10, it lends itself very well to portability. To this end, as shown in a third embodiment (FIG. 8), cube 10 may be pivotally fastened to a support platform 52 at the bottom rear edge 54 of cube 10, and provided with one (or more) adjustable rod-and-tube linkages 56 connecting cube 10 and platform 52 for purposes of positioning cube 10 at any desired inclination relative to platform 52. Linkage 56 includes, of course, a clamp 58 (e.g., a known screw-tightened split ring) for retaining cube 10 in that position. In operation, platform 52 may be oriented to the necessary azimuthal position for alignment with the location of a particular satellite, cube 10 inclined to give optimum reception for signals from that satellite, and clamp 58 tightened. Platform 52 may then be given some minor azimuthal adjustment for even better reception and finally anchored to the ground 59 in known fashion by use of one or more stakes 60, for example.

Figure 8:
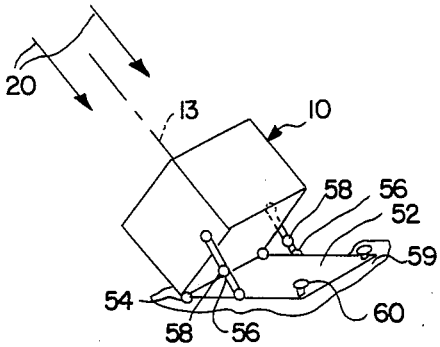
FIG. 8 shows a microwave earth station according to yet another embodiment of the invention in which a platform attached to the back of the unit of FIG. 1 is adjustable to provide support for the unit in any desired position, thus affording portable utility (to the beach, to the mountains, etc.)
Figure 9:
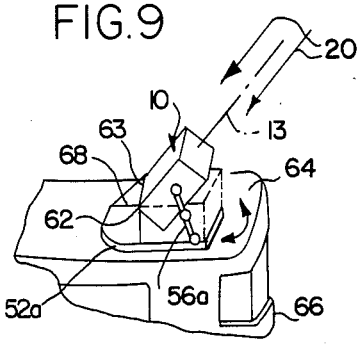
FIG. 9 shows the arrangement of FIG. 1 (or FIG. 8) adapted to support a microwave earth station on top of a recreational vehicle, the earth station normally resting behind a wind screen and being rotatable and inclinable into a position for optimum interception of a particular satellite's beam.

As shown in FIG. 9, cube 10 can also be mounted on roof 64 of a recreational vehicle 66 atop a rotatable platform **52*a* having a wind deflector 68 affixed to it with cube 10 normally located behind deflector 68 when in a lowered, "travel" condition (indicated by dashed lines). In the embodiment of FIG. 9, cube 10 is pivotally connected to wind deflector 68 by a suitable hinge 62 at top front edge 63 of cube 10. In operation, platform 52*a* may be rotated to proper azimuthal position in the manner described above with respect to FIG. 8, and locked in that position in known fashion. Cube 10 is then again inclined (shown by solid lines) to align axis 13 with beam 20 from a desired satelite and retained at that angle by use of a linkage 56*a* similar to that of FIG. 8**, say.

It may be remarked that though description of embodiments of FIGS. 8 and 9 implies manual orientation of cube 10 to align axis 13 with beam 20, it is contemplated that such could utilize the previously-mentioned power actuators and automated controls. Furthermore, while FIG. 1 shows cube 10 tiltably supported on bracket 69 (appropriate bearing inserts not being shown, but being well-known) and FIGS. 8 and 9 show cube 10 as being tiltably supported directly on platform 52 or windscreen 68, it will be clear that—if desired—cube 10 could as well be cradled in an open metal framework with the necessary bearings affixed to this last, rather than affixed to cube 10.

Although the foregoing description has been given in terms of specific details of construction, those skilled in the art will readily envision further modifications without departing from the spirit of the invention. Accordingly, it is intended that such modifications fall within the scope of the invention, which is to be limited only by the appended claims.

I claim:

1. In a microwave receiving/transmitting earth station of the type having a reflector dish in a shape concentrating intercepted rays of a microwave signal beam at a focal point on the axis of the dish, a feed horn located thereat and the dish being alternatively adapted to emit a beam of microwave signals supplied to the feed horn located at the focal point, together with means connecting the feed horn to a utilization device/source of microwaves; the combination of:

(a) a layer of thin, microwave reflective material forming said reflector dish, said dish having a front and a back;

(b) a first mass of material substantially transparent to said microwave beam and having a discrete surface portion in a shape matching said front of said layer of thin microwave reflective material layer, said first mass projecting beyond said focal point by an amount sufficient to encompass said feed horn and thereby provide the sole support therefor and spacing thereof from said dish;

(c) a second mass of said transparent material, said second mass having a particular surface portion in a shape matching said back of the dish; and (d) means integrating said layer, said first mass of transparent material, and said second mass of transparent material into a composite unit having said layer reinforcedly supported between said first and second masses.

2. The earth station of claim 1, further including a low-noise amplifier and frequency downconverter, said feed horn being connected in series with said amplifier and downconverter; and wherein said first mass likewise encompasses and provides the sole support for at least said low-noise amplifier.

3. The earth station of claim 1, wherein said first mass and said second mass comprise material of low density.

4. The earth station of claim 1, wherein said reflector dish has outer edges and said first mass has an exterior surface comprising a frontal plane normal to said axis, together with a side portion substantially parallel to said axis and coterminous with said frontal plane and said outer edges; said side portion including a further layer of material reflecting microwave radiation, said further layer being effective to reduce incidence of stray radiation on said dish.

5. The earth station of claim 1, wherein said first mass consists of rigid plastic foam having said reflector dish shape molded thereon to form said discrete surface portion.

6. The earth station of claim 5, wherein said rigid plastic foam bears an interfacial layer of fiberglass-reinforced polyurethane in the region of said discrete surface portion.

7. The earth station of claim 5, wherein said first mass and said second mass both consist of said rigid plastic foam.

8. The earth station of claim 4, wherein said reflector dish has outer edges and said first mass has an exterior surface comprising a frontal plane normal to said axis, together with a side portion substantially parallel to said axis and coterminous with said frontal plane and said outer edges; said side portion including a further layer of material reflecting microwave radiation and effective to reduce incidence of stray radiation on said dish.

9. The earth station of claim 1, wherein said first and second masses are respective portions of a parallelepiped.

10. The earth station of claim 9, wherein said parallelepiped has a plurality of edges and said axis passes through the middle of opposed ones of said edges.

11. The earth station of claim 9, wherein said parallelepiped is a cube.

12. The earth station of claim 11, wherein said cube has a plurality of edges and said axis passes through the middle of opposed ones of said edges.

13. The earth station of claim 1, wherein said feed horn includes an elongate, microwave-transparent rod rigidly attached thereto in parallel relation to said axis, and said second mass has an external opening therein defining an access cavity; said rod extending rearwardly from said first mass to said cavity within a passageway of a size sufficiently large to permit arcuate oscillation of said rod in addition to axial displacement by manual movement thereof.

14. The earth station of claim 1, wherein said earth station is in the form of a parallelepiped having a plurality of edges and further including a platform pivotally connected to one of said edges, adjustable linkages between said earth station and said platform for positioning said earth station at any desired inclination, and anchor means cooperating with said platform to immobilize this last when located in a chosen azimuthal position.

15. The earth station of claim 14, wherein said platform is rotatably mounted atop a vehicle and further comprises a windscreen portion, said windscreen portion being pivotally connected to the one of said edges of the earth station, and preceding said earth station when this last is in condition for travel.

16. In a microwave receiving/transmitting earth station of the type having a reflector dish in a shape concentrating intercepted rays of a microwave signal beam at a focal point on the axis of the dish, a feed horn being located thereat and the dish being alternatively adapted to emit a beam of microwave signals supplied to the feed horn at the focal point, together with means connecting the feed horn to a utilization device/source of microwave signals; the combination of:

(a) n modular sub-divisions of said reflector dish, each said subdivision defining an nth part of said shape and comprising (i) a layer of thin foil forming said nth part of said shape and said layer having a front and a back;

(ii) a first mass of material substantially transparent to said microwave beam and having a discrete surface portion in a shape matching said front of the foil layer, said first mass projecting beyond said focal point by an amount sufficient to contact an nth circumferential portion of said feed horn;

(iii) a second mass of said transparent material, said second mass having a particular surface portion in a shape matching said back of the layer, and (iv) means integrating said foil layer, said first mass of transparent material, and said second mass of transparent material into a composite unit having said foil layer reinforcedly supported between said first and second masses; and (b) means aligning and joining said n modular subdivisions in substantial reintegration of said shape, said first masses of the n modular subdivisions thereby jointly providing sole support for said feed horn and separation thereof from said dish.

17. The earth station of claim 16, wherein only said first masses of said n modular subdivisions contiguous to said axis provide said sole support for the feed horn.

18. The earth station of claim 17, further including a low-noise amplifier and a frequency downconverter, and wherein said feed horn is connected in series with said amplifier and downconverter; said first masses contiguous to said axis also providing the sole support for at least said amplifier.

19. The earth station of claim 16, wherein said first masses and said second masses comprise material of low density.

20. The earth station of claim 16, wherein said reflector dish has outer edges and said first mass of at least some of said n subdivisions has an exterior surface comprising a frontal portion normal to said axis, together with a side portion substantially parallel to said axis and coterminous with said foil layer and said outer edges; said side portion further including thereon a layer of material reflecting stray microwave radiation to reduce incidence thereof on said foil layer.

21. The earth station of claim 16, wherein at least said first mass of each of said n subdivisions consists of rigid plastic foam and has said nth part of said shape molded thereon to form said discrete surface portion.

22. The earth station of claim 21, wherein said rigid plastic foam bears an interfacial layer of fiberglass-reinforced polyurethane in the region of said discrete surface portion.

23. The earth station of claim 21, wherein said first mass and said second mass both consist of said rigid plastic foam.

24. The earth station of claim 21, wherein said reflector dish has outer edges and said first mass of at least some of said n subdivisions has an exterior surface comprising a frontal plane normal to said axis, together with a side portion substantially parallel to said axis and coterminous with said frontal plane and said outer edges; said side portion including thereon a further layer of material reflecting microwave radiation and effective to reduce incidence of stray radiation on said dish.

25. In a microwave receiving/transmitting earth station of the type having a reflector dish in a shape concentrating intercepted rays of a microwave signal beam at a focal point on the axis of the dish, a feed horn and low-noise amplifier being located thereat and the dish being alternatively adapted to emit a microwave signal beam supplied to the feed horn at the focal point, together with means connecting the feed horn to a utilization device/source of microwave signals; the combination of:

(a) a layer of thin foil forming said reflector dish, said layer having a front and a back;

(b) a first mass of low thermal conductivity material substantially transparent to said microwave beam and having a discrete surface portion in a shape matching said front of the foil layer, said first mass projecting beyond said focal point by an amount sufficient to encompass said feed horn;

(c) a second mass of said low thermal conductivity material, said second mass having a particular surface portion in a shape matching said back of the layer;

(d) means integrating said foil layer, said first mass of low thermal conductivity material, and said second mass of low thermal conductivity material into a composite unit having said foil layer reinforcedly supported between said first and second masses in thermal isolation; and (e) said means connecting the feed horn comprises a conductor pair connected to an external source of d-c voltage, said d-c voltage alone being supplied to power said low-noise amplifier.

26. The earth station of claim 25, wherein said feed horn and low-noise amplifier are connected in series with a frequency downconverter, said first mass likewise encompassing said downconverter and said d-c voltage also being supplied thereto.

27. The earth station of claim 25, wherein said feed horn and low-noise amplifier are lodged in a cavity in said first mass, and further including a vented access panel sealing said cavity to afford convective cooling thereof.

28. The earth station of claim 25, wherein said feed horn includes an elongate, microwave-transparent rod rigidly attached thereto in parallel relation to said axis, and said second mass has an external opening therein defining an access cavity; said rod extending rearwardly from said first mass to said cavity within a passageway of a size sufficiently large to permit arcuate oscillation of said rod in addition to axial displacement by manual movement thereof.

29. A method of forming a compact microwave earth station, comprising the steps of:

(a) providing first and second masses of low-density, low thermal conductivity, microwave-transparent material;

(b) forming matching contours on respective portions of said masses, said contours being in the shape of a parabolic microwave reflector having a predetermined focal point;

(c) forming a cavity in said first mass, said cavity having an end located at most closer to said reflector shape than to said focal point and at least located exactly at the focal point;

(d) adherently coating one of said matching contours with a layer of microwave-reflecting foil, (e) lodging a microwave feed horn and at least a low-noise amplifier in said cavity, said feed horn being located with an operative end thereof at said focal point; and (f) adherently combining said first and second masses with said layer of foil therebetween to form said compact earth station.

30. The method of claim 29, wherein said step (b) of forming said matching contours comprises molding polystyrene foam beads.

31. The method of claim 29, wherein the sequence of step c and step d is reversed.

32. The method of claim 29, further including the steps of:

(g) forming a discrete cavity in said second mass, and (h) lodging TVRO circuits in said discrete cavity.

* * * * *